US006800176B1

(12) United States Patent
Birchenall

(10) Patent No.: US 6,800,176 B1
(45) Date of Patent: Oct. 5, 2004

(54) PRESERVATION OF PAPER AND TEXTILE MATERIALS

(75) Inventor: Andrew Kelsey Birchenall, Middletown, DE (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 212 days.

(21) Appl. No.: 10/031,998

(22) PCT Filed: Jun. 13, 2000

(86) PCT No.: PCT/US00/16234

§ 371 (c)(1),
(2), (4) Date: Nov. 13, 2001

(87) PCT Pub. No.: WO00/79051

PCT Pub. Date: Dec. 28, 2000

Related U.S. Application Data

(60) Provisional application No. 60/139,651, filed on Jun. 17, 1999.

(51) Int. Cl.[7] ..... D21H 25/18

(52) U.S. Cl. ..... 162/164.1; 162/158; 162/135; 162/169; 427/140; 8/115.6

(58) Field of Search ..... 162/158, 164.1, 162/169, 135; 427/331, 342, 439, 140, 391; 8/115.51, 115.6, 116.1

(56) References Cited

U.S. PATENT DOCUMENTS 5,409,736 A * 4/1995 Leiner et al. ..... 427/372.2
5,593,483 A * 1/1997 Brunken ..... 106/2

FOREIGN PATENT DOCUMENTS

DE 19543707 A1 * 5/1997 ..... B41M/7/00
EP 717803 B1 * 4/1997 ..... B05D/3/02
WO WO 9210532 A1 * 6/1992 ..... A61L/33/00

* cited by examiner

*Primary Examiner*—José A. Fortuna

(57) ABSTRACT

A method is disclosed for strengthening a paper or textile article. The method involves (a) applying to the article a solution of an amorphous fluoropolymer in a perfluoroalkane solvent; and (b) drying the article. Also disclosed are strengthened paper and textile articles which include a fibrous paper or textile substrate, and amorphous fluoropolymer interconnecting fibers of the substrate.

10 Claims, 1 Drawing Sheet

✳ NONE

● TEFLON® AF1600

■ TEFLON® AF1601

▲ TEFLON® AF2400

◆ TEFLON® AF2130

PRESERVATION OF PAPER AND TEXTILE MATERIALS

This application claims the benefit of provisional application ser. No. 60/139,651 filed Jun. 17, 1999.

FIELD OF THE INVENTION

The present invention relates to the preservation of paper articles (e.g., books, manuscripts, documents) and textiles articles (e.g., paintings on canvas, clothing, etc.) through the application of an amorphous fluoropolymer by, for example, spraying, dipping or brushing the article to be preserved with a solution of the fluoropolymer.

BACKGROUND

Commonly owned and copending PCT International Application No. PCT/US98/26903 discloses coating a substrate (e.g., a metal, ceramic or composite) including the application of a fluoropolymer solution to seal pores.

The use of fluoropolymer dispersions to coat and protect paper and fabrics is known (see e.g., U.S. Pat. Nos. 4,742,140 and 5,674,961). Generally, these dispersions are comprised of particles in the neighborhood of 80 to 400 nm in diameter in an aqueous medium. The particles are not intended to fully or uniformly coat the fibers of paper or fabric. Also, because they are generally aqueous dispersions, items containing water-solution dyes would be damaged by contact with water.

WO A 92/10532 teaches fluorinating the surface of polymers by deposition of fluorocarbons from solution. WO A 97/19224 is a process for preserving paper by polymerizing polycondensates in situ. GB A 007 981 discloses lamination of paper or textile articles. U.S. Pat. No. 5,409,736 describes impregnation of paper with particles of oxides which hydrate to bases.

SUMMARY OF THE INVENTION

The present invention provides a method for strengthening a cellulosic paper or textile article, comprising the steps of (a) applying to the article a solution of an amorphous fluoropolymer in a perfluoroalkane solvent; and (b) drying the article so that the solvent is essentially removed.

The present invention also relates to a strengthened cellulosic paper or textile article comprising (i) a fibrous cellulosic paper or textile substrate and (ii) amorphous fluoropolymer interconnecting fibers of said substrate.

DETAILED DESCRIPTION

Figure 1:
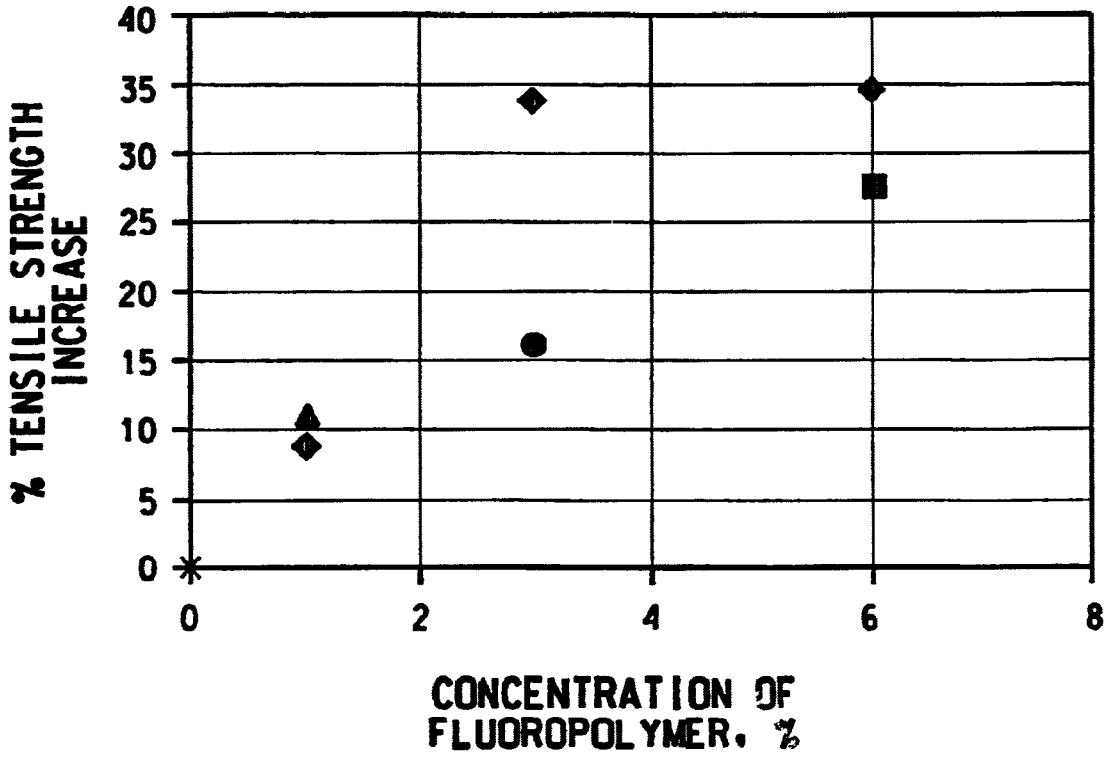
FIG. 1 represents a plot of data from Table 1.

The present invention employs amorphous fluoropolymers which, for application, are dissolved in a perfluoroalkane solvent. Articles to be preserved are treated with the fluoropolymer solution by any suitable method, including but not limited to dipping, spraying and brushing. The article may be, but is not limited to, a book, manuscript, paper, fabric, article of clothing, painting, and the like. Normally, the amorphous fluoropolymer is used substantially transparent, and consequently there is no substantial difference in appearance between the treated article and the untreated article.

When fluoropolymer is deposited from solution onto a non-porous surface, a coating of about 5 to 20 $\mu$m thick typically results. This thickness is related to the concentration of the solution used in the deposition. Generally, a 1% solution will produce a film about 5 $\mu$m thick, and a 6% solution yields a film thickness of about 50 $\mu$m. However, when the object on which the fluoropolymer is deposited is fibrous or porous, the fluoropolymer penetrates into the object. Commonly owned and copending PCT International Application No. PCT/US98/26903 and U.S. patent application Ser. No. 215,441 describe the penetration of fluoropolymer solutions into pores in thermal spray coatings which are used for corrosion protection. Fluorine x-ray fluorescence micrographs were used to demonstrate fluoropolymer penetration into the pores.

Useful herein are solutions of fluoropolymers with molecular weights in the range of from 200,000 to 400,000. These fluoropolymers are known to have excellent chemical resistance; and their solutions generally have relatively low viscosities, on the order of about 0.060–0.300 pascal seconds (60 to 300 centipoise) at shear rates from about 50 to 300 $sec^{-1}$, which enables them to flow into the pores. The location of the fluoropolymer in the pores is also important because, unlike purely surface films, the material is not easily abraded or worn away. Rather, the fluoropolymer in the pore is protected from abrasion by the surrounding porous coating as well as any surface coating. Moreover, the fibers of the substrate are interconnected with fluoropolymer, thereby strengthening the article.

Treating paper with fluoropolymer solutions can significantly increase the tensile strength of paper, as shown in Example 2 below, as well as typically impart other desirable properties. The films or deposits have very low surface energies compared to untreated paper (e.g., in the range of 15 to 19 dynes/cm). Thus, they are generally difficult to wet with liquids such as water. Solid deposits like dirt, dust or inks will not easily adhere to such surfaces. The permeation of aggressive chemical constituents of the environment which may degrade or corrode the object is retarded, as the solutions penetrate into the bulk of the material as well as depositing on the surface. Finally, the fluoropolymer film or deposit itself is very inert to degradation from environmental chemicals.

One use for this invention is the preservation of a variety of papers, including books, newspaper pages and documents. As paper ages, it frequently becomes more brittle. This is a problem for historic books and documents of great age. Treatment of these papers with the fluoropolymer solutions, as described in this invention, have been shown to increase the tensile strength of the paper, as shown in the Examples below. As outlined in Examples 1 and 2 below, a paper or book can be dipped into the fluoropolymer/perfluoroalkane solution and air dried to remove the solvent. The treated papers do not absorb water and therefore do not fall apart when immersed in water. No radical change in appearance or feel of the paper is normally noted for those with relatively low gloss, such as newsprint or copier paper. For glossier papers, a thin external film of polymer can ordinarily be seen on close visual inspection. Typically, no blurring or removal of ink is noted. Writing on treated paper with soft pointed, felt tip pens is typically more difficult than on untreated paper, although it is still relatively easy to mark with hard pointed, ball point pens. In general, it is more difficult to get treated articles dirty, and easier to clean them.

The treatment of the paper is considered reversible. The deposited polymer can be substantially removed by treating the treated paper with pure solvent to redissolve the fluoropolymer.

Textiles are fibrous materials, somewhat similar to paper in their behavior when exposed to these fluoropolymer solutions. These solutions penetrate into the weave, and upon drying leave fluoropolymer deposits, thereby increasing the strength of the textile. The textile material is made resistant to water or liquid absorption. Dyes used on the textile will not be affected by the solvent used, and the textile will be resistant to staining. A fluoropolymer film formed around the fibers protects them from environmental degradation by limiting the permeation of environmental chemicals and gasses through the film. The process of this invention would be useful in preserving historical and heirloom textiles and garments, such as tapestries, costumes, wedding gowns and the like.

Paintings consist of paint or ink on a porous or fibrous substrate like canvas or paper. The fluoropolymer solution will deposit a film around the paint or ink which protects it from environmental degradation. The porous or fibrous substrate will be come infiltrated with the polymer. The strength of the material would be increased. The painting would be resistant to water or liquid absorption, as well as staining.

The treatment of this invention is particularly useful for paper or textile having images made of ink, pigment or dye which is soluble in water, but not in perfluoroalkane solvents.

A variety of amorphous fluoropolymers may be used as the strengthener of this invention. This includes fluorine-containing homopolymers and co-polymers which are soluble at 0.5% by weight or greater in the solvent. An amorphous fluoropolymer is one which does not contain significant amounts of crystallinity when measured by DSC, or whose heat of melting is less than 2 J/g.

Suitable fluoropolymers include amorphous fluoropolymers which are copolymers containing units from functional fluorinated comonomers or nonfunctional comonomers. Examples are copolymers of tetrafluoroethylene (TFE) with functional or non-functional monomers such as fluoroolefins having from 2 to 8 carbon atoms and fluorinated alkyl vinyl ether in which the alkyl group contains from 1 to 5 carbon atoms (e.g., 1, 3, 4 or 5 carbon atoms). Examples of the non-functional monomers include hexafluoropropylene (HFP), chlorotrifluoro ethylene (CTFE), perfluoro(ethyl vinyl ether) (PEVE), perfluoro(methyl vinyl ether) (PMVE) and perfluoro(propylene vinyl ether) (PPVE). Functional monomers include, for example, perfluoroethyl vinyl ether (EVE), $CF_2{=}CFOCF_2CF(CF_3)OCF_2CF_2COOCH_3$, $CF_2{=}CFOCF_2CF(CF_3)OCF_2CF_2SO_2F$, $CF_2{=}CFOCF_2CF(CF_3)OCF_2CF_2CN$, $C_3N_3(CF_2CF_2OCF(CF_3)CF_2OCF{=}CF_2)_3$ (EVE-triazine), $CF_2{=}CFOCF_2CF(CF_3)OCF_2CF_2CH_2OH$, $CF_2{=}CFOCF_2CF(CF_3)OCF_2CF_2CH_2PO_2(OH)_2$ (EVE-P), $CF_2{=}FOCF_2CF(CF_3)OCF_2CF_2COOH$, and 4,5-difluoro-2,2-bis(trifluoromethyl)-1,3-dioxole (PDD). Commercially available materials include those from DuPont, Wilmington, Del.: Teflon® SF60 (TFE/PMVE/PEVE, DuPont, Wilmington Del.), Teflon® SF61 (TFE/PMVE/PEVE/EVE-P), Teflon® SF50 (TFE/HFP), Teflon® AF1600, 1601 and 2400 (PDD/TFE), and Teflon® AF2130 (PDD/CTFE); and those from Asahi Glass, Japan: Cytop®.

Of note are amorphous fluoropolymers which comprise copolymerized units of TFE and PEVE. Amorphous copolymers of tetrafluoroethylene and perfluoro(ethyl vinyl ether) are disclosed in U.S. Pat. Nos. 5,478,905, 5,637,663 and 5,663,255, and in commonly owned, co-pending U.S. patent application Ser. No. 08/929,213, which are incorporated herein by reference. Copolymers including units from TFE and PEVE may also include units from one or more additional fluorinated monomers. A preferred additional monomer is PMVE. When perfluoro(methyl vinyl ether) is present in the fluoropolymer, perfluoro(ethyl vinyl ether) is preferably at least 15% of the combined weight of the combined perfluoro(ethyl vinyl ether) and perfluoro(methyl vinyl ether).

Also of note are amorphous fluoropolymers which comprise copolymerized units of TFE and PDD, or CTFE and PDD. Examples of these copolymers are known collectively as Teflon® AF, available from DuPont Company, Wilmington, Del. Various grades are available, including Teflon® AF1600, 1601 and 2400 (PDD/TFE) and Teflon® AF2130 (PDD/CTFE).

A perfluoroalkane solvent is a non-aqueous solvent in which a perfluoroalkane is the primary component. Suitable solvents include perfluorinated alkanes such as perfluorooctane. Suitable solvents also include mixtures which include perfluoroalkanes, such as FC-75 and FC-40 (3M, Minneapolis, Minn.). In general, the perfluoroalkane solvents used in these solutions are not considered aggressive to many paper and textile articles. Most inks will not dissolve in perfluorinated solvents. Similarly, many substrates are unaffected by exposure to these solvents.

The fluoropolymer solutions may be applied to the fibrous articles by common coating methods, including but not limited to spray application, dipping and brushing. After application of the solutions, the articles can be dried by conventional methods (e.g., air or vacuum drying).

EXAMPLES

Fluoropolymer Solution Preparation:

Teflon® AF solutions were used in the examples below, and were used as received from E. I. du Pont de Nemours and Company, Wilmington, Del., unless otherwise noted. To dilute the Teflon® AF2130, solvent (FC-75, 3M, Minneapolis, Minn.) was weighed and was placed into a container, with the calculated amount of Teflon® AF2130 added to the solvent. The samples were mixed before use.

EXAMPLE 1

Paper Treatment

Several types of paper, including newsprint and copier paper were dipped for about 30 seconds into several Teflon® AF solutions, having concentrations between 1 and 6% solids by weight, such that about half the sheet was impregnated with the solution. The papers were removed from the solution and dried for about 30 minutes. The entire sheets of paper were immersed in water at room temperature. The treated portion emerged in undamaged condition while the untreated paper fell apart. No dissolution or blurring of ink was observed in the treated portion of the newsprint.

EXAMPLE 2

Strength Testing of Paper

The strength of treated paper was compared to that of an untreated paper. Strips of paper (20 pound White Wove, Gilbert, Inc., Menasha, Wis.) about 2.5 cm (1 inch) wide, 20.3 cm (8 inches) long, and 0.010 cm (0.004 inches) thick, were immersed for 10 minutes in solutions with varying concentrations of fluoropolymer. The strips were removed and dried, leaving a fluoropolymer deposit in the paper. The tensile strengths of the strips were measured using a model 1122 Instron test machine (Instron Corp., Canton, Mass.) and ASTM Method D 828 procedures (the test bars were held in grips with a separation of 5 inches, and the cross head speed was 2 inches/minute). The fluoropolymer treatment increased the strength of the paper. The results are shown in Table 1 below, as well as in FIG. 1.

TABLE 1

| Fluoropolymer Solution Identification | Concentration of Fluoropolymer, % | MPa | Strength, Ksi | % Increase in Strength vs. Control |
|---|---|---|---|---|
| None | 0 | 44.0 | 6.38 | — |
| TEFLON ® AF1600 | 3 | 51.2 | 7.42 | 16.3 |
| TEFLON ® AF1601 | 6 | 56.1 | 8.14 | 27.6 |
| TEFLON ® AF2400 | 1 | 48.9 | 7.09 | 11.1 |
| TEFLON ® AF2130 | 6 | 59.3 | 8.60 | 34.8 |
| TEFLON ® AF2130 | 3 | 59.0 | 8.55 | 34.0 |
| TEFLON ® AF2130 | 1 | 47.8 | 6.94 | 8.8 |

What is claimed is:

1. A method for strengthening a cellulosic paper article, comprising the steps of:

(a) applying to the article a solution of an amorphous fluoropolymer in a perfluoroalkane solvent; and (b) drying the article so that the solvent is essentially removed.

2. The method of claim 1 wherein the fluoropolymer has a molecular weight in the range of from 200,000 to 400,000.

3. The method of claim 1 wherein the fluoropolymer is a copolymer of 4,5-difluoro-2,2-bis(trifluoromethyl)-1,3-dioxole with either tetrafluoroethylene or chlorotrifluoroethylene.

4. The method of claim 1 wherein the fluoropolymer is a copolymer of tetrafluoroethylene with a monomer selected from fluoroolefins having from 2 to 8 carbon atoms and fluorinated alkyl vinyl ethers where the alkyl group contains from 1 to 5 carbons.

5. A strengthened cellulosic paper article, comprising:

(i) a fibrous cellulosic paper substrate; and (ii) amorphous fluoropolymer interconnecting fibers of said substrate.

6. The strengthened cellulosic paper article of claim 5 wherein the fluoropolymer has a molecular weight in the range of from 200,000 to 400,000.

7. The strengthened cellulosic paper article of claim 5 wherein the fluoropolymer is a copolymer of 4,5-difluoro-2,2-bis(trifluoromethyl)-1,3-dioxole with either tetrafluoroethylene or chlorotrifluoroethylene.

8. The strengthened cellulosic paper article of claim 5 wherein the fluoropolymer is a copolymer of tetrafluoroethylene with a monomer selected from fluoroolefins having from 2 to 8 carbon atoms and fluorinated alkyl vinyl ethers where the alkyl group contains from 1 to 5 carbons.

9. An article of paper or textile comprising:

a) a pattern or printing, and b) an amorphous fluoropolymer coating applied from an amorphous fluoropolymer solution such that the information conveyed by the pattern or printing is not obscured or distorted.

10. The process of treating an article of paper or textile comprising a) applying a pattern or printing to a paper or textile article, b) applying to the article a solution of an amorphous fluoropolymer in a perfluoroalkane solvent; and c) drying the article so that the solvent is essentially removed.

* * * * *